US011326812B2

(12) United States Patent
Luo et al.

(10) Patent No.: US 11,326,812 B2
(45) Date of Patent: May 10, 2022

(54) HEAT PUMP SYSTEM WITH ELECTROMAGNETIC-INDUCTION HEATING AND CONTROL METHOD THEREFOR

(71) Applicants: HEFEI MIDEA HEATING & VENTILATING EQUIPMENT CO., LTD., Hefei (CN); GD MIDEA HEATING & VENTILATING EQUIPMENT CO., LTD., Foshan (CN)

(72) Inventors: Bin Luo, Hefei (CN); Yuanyang Li, Hefei (CN); Shuqing Liu, Hefei (CN); Kun Yang, Hefei (CN); Lei Zhan, Hefei (CN)

(73) Assignees: HEFEI MIDEA HEATING & VENTILATING EQUIPMENT CO., LTD., Anhui (CN); GD MIDEA HEATING & VENTILATING EQUIPMENT CO., LTD., Guangdong (CN)

( * ) Notice: Subject to any disclaimer, the term of this patent is extended or adjusted under 35 U.S.C. 154(b) by 139 days.

(21) Appl. No.: 16/620,133

(22) PCT Filed: Jun. 3, 2019

(86) PCT No.: PCT/CN2019/089850
§ 371 (c)(1),
(2) Date: Dec. 6, 2019

(87) PCT Pub. No.: WO2019/242493
PCT Pub. Date: Dec. 26, 2019

(65) Prior Publication Data

US 2020/0141614 A1 May 7, 2020

(30) Foreign Application Priority Data

Jun. 20, 2018 (CN) ..... 201810628493.X
Jun. 20, 2018 (CN) ..... 201820955994.6

(51) Int. Cl.
*F25B 30/02* (2006.01)
*F25B 49/02* (2006.01)
*H05B 6/36* (2006.01)

(52) U.S. Cl.
CPC ..... *F25B 30/02* (2013.01); *F25B 49/02* (2013.01); *H05B 6/36* (2013.01)

(58) Field of Classification Search
CPC ..... F25B 30/02; F25B 49/02; H05B 6/36
See application file for complete search history.

(56) References Cited

U.S. PATENT DOCUMENTS 8,657,207 B2 * 2/2014 Back ..... F24D 19/0095 237/2 B
2008/0277095 A1 * 11/2008 Zhai ..... F28F 1/025 165/80.4

(Continued)

FOREIGN PATENT DOCUMENTS

CN 101354149 A 1/2009
CN 201196507 Y 2/2009

(Continued)

OTHER PUBLICATIONS

International Search Report and Written Opinion dated Sep. 2, 2019 from State Intellectual Property Office of the P.R. China.

(Continued)

*Primary Examiner* — Henry T Crenshaw
(74) *Attorney, Agent, or Firm* — Dilworth & Barrese, LLP.; Michael J. Musella, Esq.

(57) ABSTRACT

A heat pump system and a control method therefor are provided. The heat pump system includes an outdoor heat (Continued)

exchanger and an electromagnetic heating assembly. The electromagnetic heating assembly includes an induction heating sheet, an insulation plate, and an electromagnetic induction wire coil. The induction heating sheet is in contact with the outdoor heat exchanger, the electromagnetic induction wire coil is attached to the insulation plate, the insulation plate is connected to the outdoor heat exchanger or the induction heating sheet, the induction heating sheet is coupled with the electromagnetic induction wire coil by communication.

19 Claims, 7 Drawing Sheets

(56) References Cited

U.S. PATENT DOCUMENTS

| | | | | |
|---|---|---|---|---|
| 2011/0314852 | A1 | 12/2011 | Kinoshita et al. | |
| 2013/0201316 | A1* | 8/2013 | Binder | H04L 67/12 348/77 |

FOREIGN PATENT DOCUMENTS

| | | | | |
|---|---|---|---|---|
| CN | 103968627 | A | | 8/2014 |
| CN | 108759169 | A | | 11/2018 |
| CN | 208458307 | U | | 2/2019 |
| EP | 2159494 | A2 | | 3/2010 |
| EP | 2410265 | A1 | | 1/2012 |
| JP | 04257673 | A | | 9/1992 |
| KR | 20090099612 | A | | 9/2009 |
| WO | WO 2014 117 511 | | * | 8/2007 |
| WO | 2014117511 | A1 | | 8/2014 |

OTHER PUBLICATIONS

Extended European Search Report from European Patent Application No. 19812899.3 dated Dec. 8, 2020.

* cited by examiner

HEAT PUMP SYSTEM WITH ELECTROMAGNETIC-INDUCTION HEATING AND CONTROL METHOD THEREFOR

CROSS-REFERENCE TO RELATED APPLICATIONS

This application is a U.S. national stage filing of PCT/CN2019/089850 filed Jun. 3, 2019, and is based upon and claims priority to Chinese Patent Application Serial No. 201810638493.X, filed on Jun. 20, 2018, and Chinese Patent Application Serial No. 201820955994.6 filed on Jun. 20, 2018, the entire contents each of which are incorporated herein by reference.

FIELD

The present disclosure relates to a field of household appliances, and more particularly, to an heat pump system and a control method therefor.

BACKGROUND

When a heat pump system operates in a heating mode, a refrigerant absorbs heat from outdoor air by means of an outdoor heat exchanger, then a pressure and a temperature are raised by means of a compressor, and an outdoor heat is discharged into an indoor environment to achieve a heating effect. However, in a heating mode in the winter, the lower the outdoor temperature, the lesser the heat can be transferred into the indoor environment from the outdoor environment, the worse the heating effect in the indoor environment. Since the refrigerant in the outdoor heat exchanger needs to absorb the heat from the outdoor air, a temperature of the refrigerant should be lower than a temperature of the outdoor air, resulting in frosting on the outdoor heat exchanger in the heating mode.

In the related art, in order to guarantee that a system can safely, effectively, and continuously operate to provide heat, defrosting for the outdoor heat exchanger is needed at set intervals, heat is absorbed from an indoor side for defrosting the outdoor heat exchanger. This kind of defrosting result in reduction in an indoor temperature for 10 min, and when the outdoor unit restores the heating mode again, a period of time is also needed to switch and start the compressor to gradually heating a refrigerant system, thereby providing a service of heating operation. When a unit starts heating at a low temperature, the compressor needs to operate in a preheat mode for a long time to rise a temperature of a refrigerant discharged by the compressor due to large solubility of oil in the refrigerant, such that it is guaranteed that overmuch refrigeration oil is not carried by the evaporated refrigerant, and normal operation of the compressor is not affected.

When the outdoor temperature is low and reaches a certain extent, the heat that can be absorbed from the outdoor environment if very low, to the extent that the indoor heating capacity could as well directly uses the electric energy for the compressor for the energy acquired by an electrical heater. However, a common indoor unit, especially an indoor unit of a multi-coupled machine is not provided with electrical heating generally, and even electrical heating of the indoor unit is started, potential safety hazard can be caused by indoor electrical heating because configuration of indoor side wires cannot support service for a long time.

SUMMARY

The present disclosure seeks to solve at least one of the technical problems existing in the related art. To this end, an objective of the present disclosure provides a heart pump system with defrosting capacity and good usability.

The present disclosure also provides a control method for a heat pump system, and the method is easy and good in control effect.

The heat pump system according to embodiments of the present disclosure includes: an outdoor heat exchanger and an electromagnetic heating assembly. The electromagnetic heating assembly includes an induction heating sheet, an insulation plate, and an electromagnetic induction wire coil. The induction heating sheet is in contact with the outdoor heat exchanger, the electromagnetic induction wire coil is attached to the insulation plate, the insulation plate is connected to the outdoor heat exchanger or the induction heating sheet, and the induction heating sheet is coupled with the electromagnetic induction wire coil by communication.

In the heat pump system according to embodiments of the present disclosure, the outdoor heat exchanger is provided with the electromagnetic heating assembly, the electromagnetic heating assembly can heat the outdoor heat exchanger to raise its temperature, thereby raising defrosting efficiency and heating efficiency of the outdoor heat exchanger and improving a starting capacity of the heat pump system in case of "freeze". Debasement of reliability of the compressor due to insufficient discharge temperature can be avoided, and the usability of the heat pump system can be improved. Moreover, the electromagnetic heating assembly emits heat based on the principle of magnetic field, not only comparatively high safety is achieved, but also advantages, such as a simple structure, high heating precision, quick heating speed, and easy control can be brought out. In addition, the insulation plate can insulate the electromagnetic induction wire coil from the induction heating sheet, such that the induction heating sheet can be prevented from affecting operation performance of the electromagnetic induction wire coil.

According to some embodiments of the present disclosure, the outdoor heat exchanger is configured as a heat exchange tube, the induction heating sheet is located in the heat exchange tube, and the insulation plate is attached to an outer peripheral wall of the heat exchange tube.

In some embodiments of the present disclosure, the heat exchange tube has two opposite outer surfaces being a first surface and a second surface; two insulation plates are provided, the two insulation plates being a first insulation plate and a second insulation plate, the first insulation plate is attached to the first surface, and the second insulation plate is attached to the second surface; and two electromagnetic induction wire coils are provided, the two electromagnetic induction wire coils being a first electromagnetic induction wire coil and a second electromagnetic induction wire coil, the first electromagnetic induction wire coil is attached to the first insulation plate, and the second electromagnetic induction wire coil is attached to the second insulation plate.

According to some embodiments of the present disclosure, the outdoor heat exchanger is configured as a microchannel plate.

In some embodiments of the present disclosure, the induction heating sheet is attached to an outer peripheral wall of the outdoor heat exchanger.

In some embodiments of the present disclosure, the electromagnetic heating assembly comprises two induction heating sheets, the two induction heating sheets are located at opposite outer surfaces of the microchannel plate, and the insulation plate is attached to one of the induction heating sheets.

In some embodiments of the present disclosure, two microchannel plates are provided, and the induction heating sheet is sandwiched between the two microchannel plates.

According to some embodiments of the present disclosure, two electromagnetic heating assembles are provided, the induction heating sheet, the insulation plate, and the electromagnetic induction wire coil of each of the electromagnetic heating assemblies are superposed in sequence, and the induction heating sheet is attached to an outer surface of the outdoor heat exchanger.

In some embodiments of the present disclosure, the two electromagnetic heating assembles are arranged at opposite surfaces of the outdoor heat exchanger respectively.

According to some embodiments of the present disclosure, the electromagnetic induction wire coil is circular, oval, or polygonal.

As for the control method for a heat pump system according to embodiments of the present disclosure, the heat pump system is the above heat pump system, the heat pump system includes a temperature sensor configured to detect a discharge temperature of a compressor, the discharge temperature detected by the temperature sensor is represented by T, and a target discharge temperature of the heat pump system is represented by $T_0$, the control method comprises: starting the electromagnetic heating assembly when the heat pump system is in a heating-start mode or a defrosting mode.

Based on the control method for the heat pump system according to embodiments of the present disclosure, when the heat pump system is in a heating-start mode or a defrosting mode, the electromagnetic heating assembly can heat the outdoor heat exchanger to raise its temperature, thereby raising defrosting efficiency and heating efficiency of the outdoor heat exchanger and improving a starting capacity of the heat pump system in case of "freeze", Debasement of reliability of the compressor due to insufficient discharge temperature can be avoided, and the usability of the heat pump system can be improved. Moreover, the electromagnetic heating assembly emits heat based on the principle of magnetic field, not only comparatively high safety is achieved, but also advantages, such as a simple structure, high heating precision, quick heating speed, and easy control can be brought out. In addition, the insulation plate can insulate the electromagnetic induction wire coil from the induction heating sheet, such that the induction heating sheet can be prevented from affecting operation performance of the electromagnetic induction wire coil.

According to some embodiments of the present disclosure, in a normal heating mode, if T is less than $T_0$, and the compressor reaches a maximum frequency, the electromagnetic heating assembly is started; and if T is greater than or equal to $T_0$, and the compressor does not reach the maximum frequency, the electromagnetic heating assembly stops heating.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of embodiments of the present disclosure will become apparent and more readily appreciated from the following descriptions made with reference to the drawings.

Figure 1:
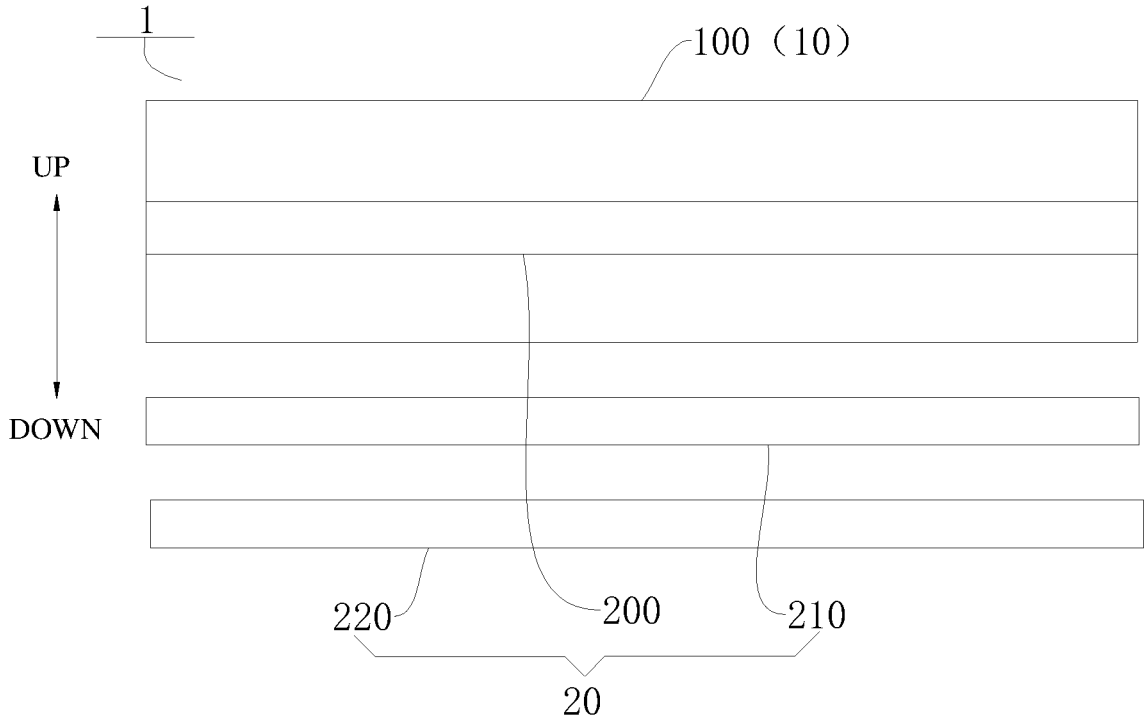
FIG. 1 is a simplified view of a heat pump system according to embodiments of the present disclosure.
Figure 2:
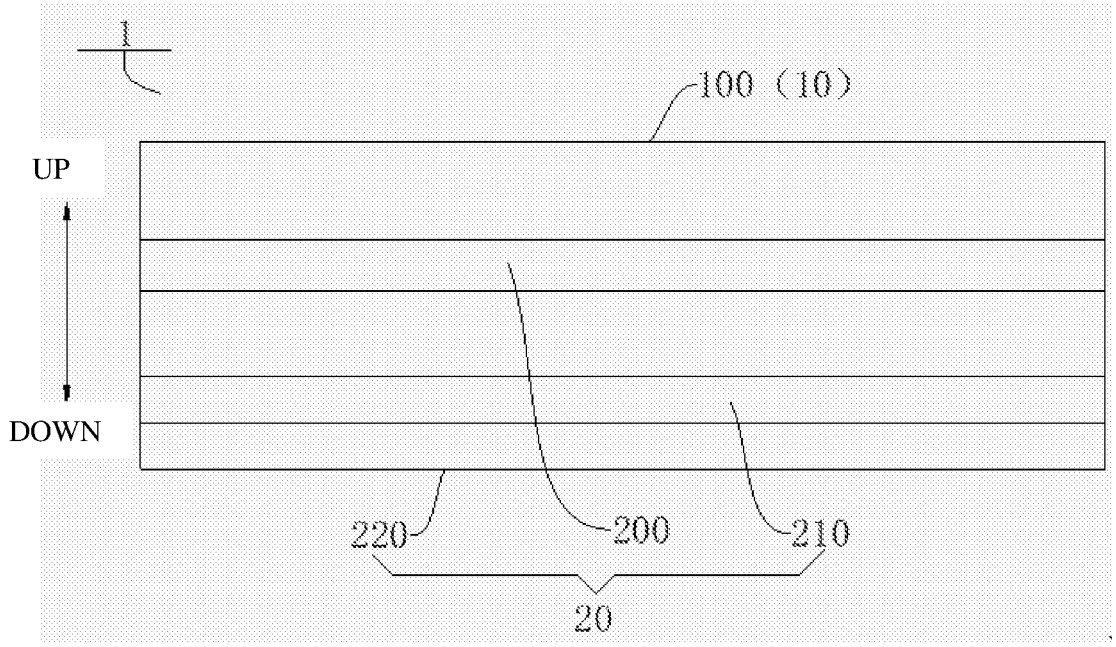
FIG. 2 is a simplified view of a heat pump system according to embodiments of the present disclosure.

REFERENCE NUMERALS heat pump system 1, outdoor heat exchanger 10, heat exchange tube 100, first surface 101, second surface 102, microchannel plate 110, electromagnetic heating assembly 20, induction heating sheet 200, insulation plate 210, first insulation plate 211, second insulation plate 212, electromagnetic induction wire coil 220, first electromagnetic induction wire coil 221, second electromagnetic induction wire coil 222.

DETAILED DESCRIPTION

Embodiments of the present disclosure are described in detail, and examples of the embodiments are depicted in the drawings. The same or similar elements and the elements having same or similar functions are denoted by like reference numerals throughout the descriptions. The embodiments described herein with reference to drawings are explanatory and only used to illustrate the present disclosure. The embodiments shall not be construed to limit the present disclosure.

As shown in FIG. 1 to FIG. 11, a heat pump system 1 according to embodiments of the present disclosure includes an outdoor heat exchanger 10 and an electromagnetic heating assembly 20.

For example, as shown in FIG. 1 to FIG. 11, the electromagnetic heating assembly 20 includes an induction heating sheet 200, an insulation board 210 and an electromagnetic induction wire coil 220. The induction heating sheet 200 is in contact with the outdoor heat exchanger 10, the electromagnetic induction wire coil 220 is attached to the insulation plate 210, the insulation plate 210 is connected to the outdoor heat exchanger 10 or the induction heating sheet 200, and the induction heating sheet 200 is coupled with the electromagnetic induction wire coil 220 by communication. For example, the insulation plate 210 can be arranged on the outdoor heat exchanger 10, and the insulation plate 210 also can be arranged on the induction heating sheet 200. The electromagnetic induction wire coil 220 can be attached to a side of the insulation plate 210 away from the outdoor heat exchanger 10 or the induction heating sheet 200. The induction heating sheet 200 is in contact with and connected to the outdoor heat exchanger 10, and the induction heating sheet 200 is coupled with the electromagnetic induction wire coil 220 by communication. The electromagnetic induction wire coil 220 can generate an alternating magnetic field, in order to cause an eddy with the induction heating sheet 200 to generate heat energy. It should be noted that, the terms "connect" and "couple" referred herein should be understood broadly and may refer to direct connections or indirect connections, which can be realized by snapping, threading, bonding, etc. In addition, the induction heating sheet 200 can be an irony induction heating sheet 200 containing an iron element, so as to cause the eddy with the alternating magnetic field generated by the electromagnetic induction wire coil 220.

In the related art, the heat pump system is low in starting capacity in case of "freeze" when heating at a low temperature in cold region. Refrigeration oil is easily discharged from an oil separator by carrying if a discharge temperature is insufficient, affecting reliability of a compressor. Moreover, a defrosting speed is slow, and a heating effect is poor.

In the heat pump system 1 according to embodiments of the present disclosure, the outdoor heat exchanger 10 is provided with the electromagnetic heating assembly 20, the electromagnetic heating assembly 20 can heat the outdoor heat exchanger 10 to raise its temperature, thereby raising defrosting efficiency and heating efficiency of the outdoor heat exchanger 10 and improving a starting capacity of the heat pump system 1 in case of "freeze". Debasement of reliability of the compressor due to insufficient discharge temperature can be avoided, and the usability of the heat pump system 1 can be improved. Moreover, the electromagnetic heating assembly 20 emits heat based on the principle of magnetic field, not only comparatively high safety is achieved, but also advantages, such as a simple structure, high heating precision, quick heating speed, and easy control can be brought out. In addition, the insulation plate 210 can insulate the electromagnetic induction wire coil 220 from the induction heating sheet 200, such that the induction heating sheet 200 can be prevented from affecting operation performance of the electromagnetic induction wire coil.

As shown in FIG. 1 to FIG. 4, according to some embodiments of the present disclosure, the outdoor heat exchanger 10 can be a heat exchange tube 100, the induction heating sheet 200 is located in the heat exchange tube 100, and the insulation plate 210 is attached to an outer peripheral wall of the heat exchange tube 100. The electromagnetic induction wire coil 220 can be attached to a side of the insulation plate 210 away from the heat exchange tube 100. Therefore, the induction heating sheet 200 can be in direct heat exchange with a refrigerant in the heat exchange tube 100, the induction heating sheet 200 can heat the refrigerant in the heat exchange tube 100, thereby raising a heating efficiency of the outdoor heat exchanger 10, and the refrigerant can further exchange heat with the heat exchange tube 100, thereby raising a temperature of the heat exchange tube 100, and then defrosting.

According to some embodiments of the present disclosure, the insulation plate 210 can be an insulation member. The outdoor heat exchanger 10 can be a metal member or a nonmetal member.

Figure 3:
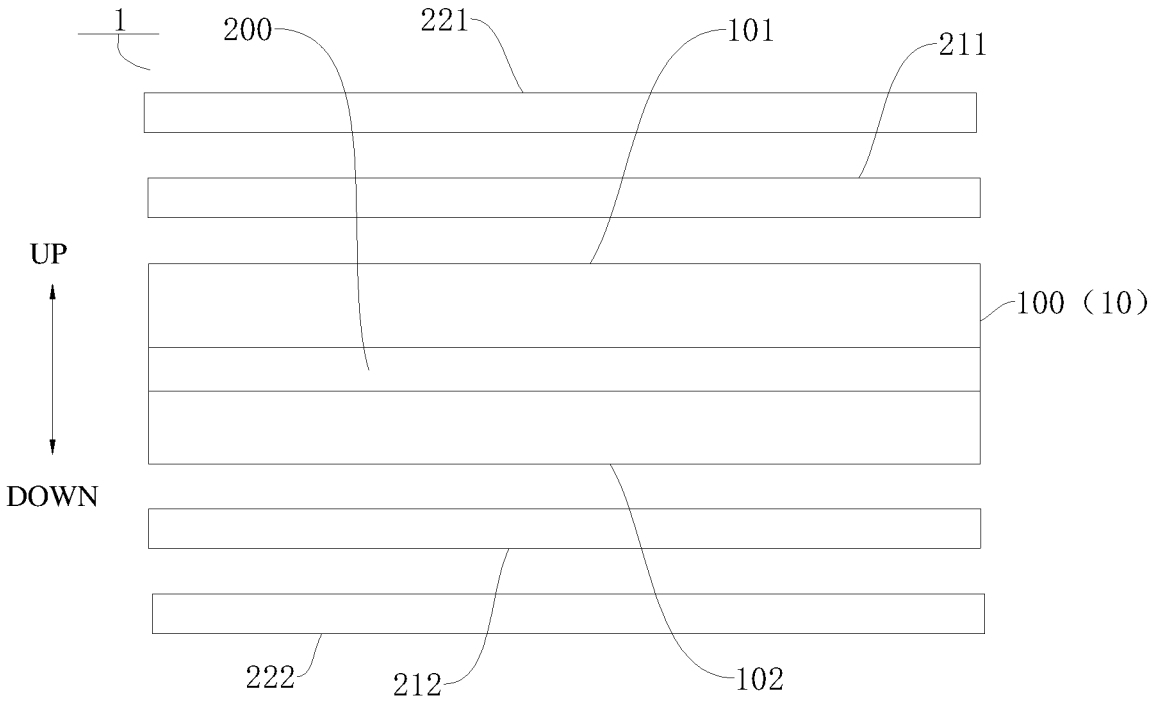
FIG. 3 is a simplified view of a heat pump system according to embodiments of the present disclosure.
Figure 4:
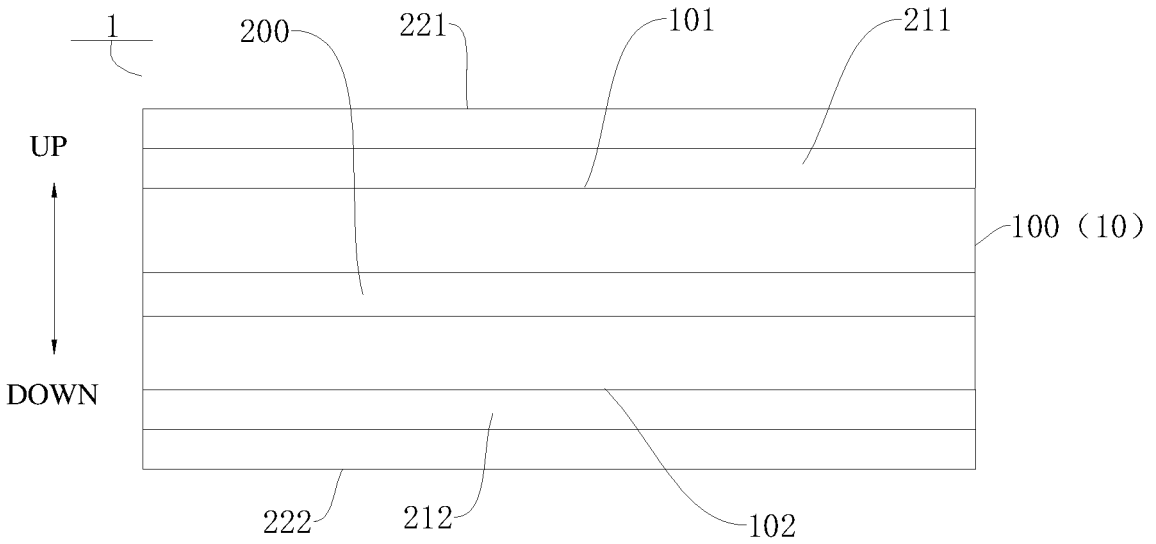
FIG. 4 is a simplified view of a heat pump system according to embodiments of the present disclosure.
Figure 5:
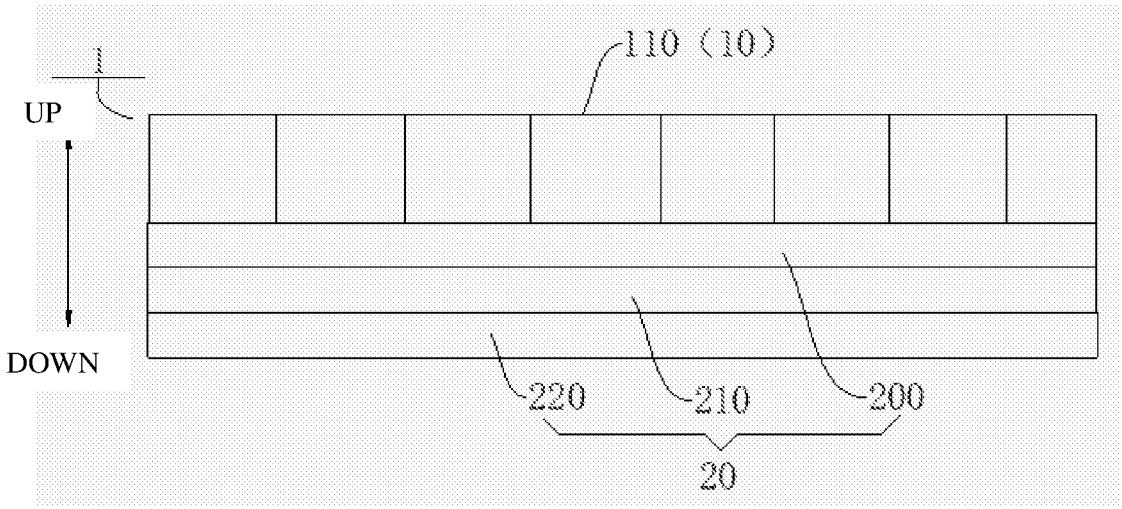
FIG. 5 is a simplified view of a heat pump system according to embodiments of the present disclosure.

As shown in FIG. 3 and FIG. 4, in some embodiments of the present disclosure, the heat exchange tube 100 has two opposite outer surfaces, the two opposite outer surfaces are a first surface 101 and a second surface 102. Two insulation plates 210 are provided, and the two insulation plates are a first insulation plate 211 and a second insulation plate 212. The first insulation plate 211 is attached to the first surface 101, and the second insulation plate 212 is attached to the second surface 102. Two electromagnetic induction wire coils 220 can be provided, the two electromagnetic induction wire coils are a first electromagnetic induction wire coil 221 and a second electromagnetic induction wire coil 222, the first electromagnetic induction wire coil 221 is attached to the first insulation plate 211, and the second electromagnetic induction wire coil 222 is attached to the second insulation plate 212. Therefore, both the first electromagnetic induction wire coil 221 and the second electromagnetic induction wire coil 222 can heat the induction heating sheet 200 by induction, thereby raising the heating efficiency of the induction heating sheet 200 \.

As shown in FIG. 5 to FIG. 8, according to some embodiments of the present disclosure, the outdoor heat exchanger 10 can be a microchannel plate 110. The microchannel plate 110 is a plate with a plurality of micro channels, and the refrigerant can pass through the plurality of micro channels. The microchannel plate 110 can enlarge a contact area between the refrigerant and walls of the micro channels, thereby improving heat exchange performance of the microchannel plate 110. The micro channels have a diameter ranging from 10 μm to 1000 μm.

As shown in FIG. 1 to FIG. 11, in some embodiments of the present disclosure, the induction heating sheet 200 is attached to the outer peripheral wall of the outdoor heat exchanger 10. Therefore, a contract area between the induction heating sheet 200 and the outdoor heat exchanger 10 can be enlarged, thereby raising the heating efficiency of the induction heating sheet 200.

Figure 6:
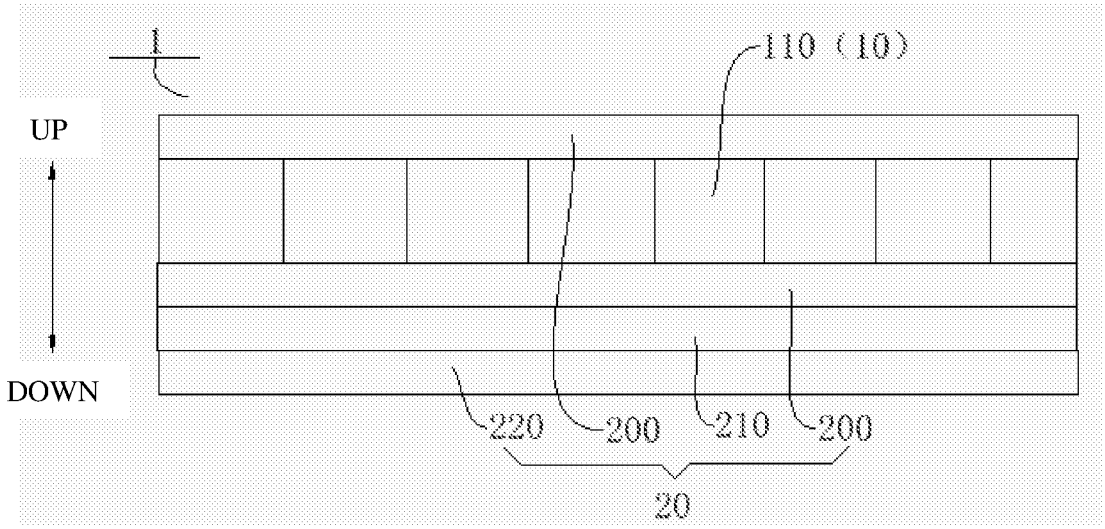
FIG. 6 is a simplified view of a heat pump system according to embodiments of the present disclosure.

As shown in FIG. 6, in some embodiments of the present disclosure, the electromagnetic heating assembly 20 includes two induction heating sheets 200, and the two induction heating sheets 200 are located on opposite outer surfaces of the microchannel plate 110, and the insulation plate 210 is attached to one of the induction heating sheets 200. For example, the microchannel plate 110 can have two opposite surfaces, the two opposite surfaces are an upper surface and a lower surface (referring to an up-down direction shown in FIG. 6). One induction heating sheet 200 is attached to the upper surface, and one induction heating sheet 200 is attached to the lower surface. The insulation plate 210 can be attached to a side of the induction heating sheet 200 on the lower surface away from the microchannel plate 110, and the electromagnetic induction wire coil 220 can be attached to a side of the insulation plate 210 away from the induction heating sheet 200. Therefore, two induction heating sheets 200 can be used for heating the microchannel plate 110. Moreover, the microchannel plate 110 is sandwiched between the two the induction heating sheet 200, such that the contact area between the induction heating sheet 200 and the microchannel plate 110 can be fully enlarged, and the defrosting efficiency and the heating efficiency of the microchannel plate 110 can be raised. In the description of the present disclosure, it should be noted that, the terms "up," "upper," "down," "lower" refer to the orientation or relation as shown in FIG. 6 for convenience of description of the present disclosure and simplification of the description, but do not alone indicate or imply that the device or element referred to must have a particular orientation, or is constructed or operated in a particular orientation, which shall not be construed to limit the present disclosure.

Figure 7:
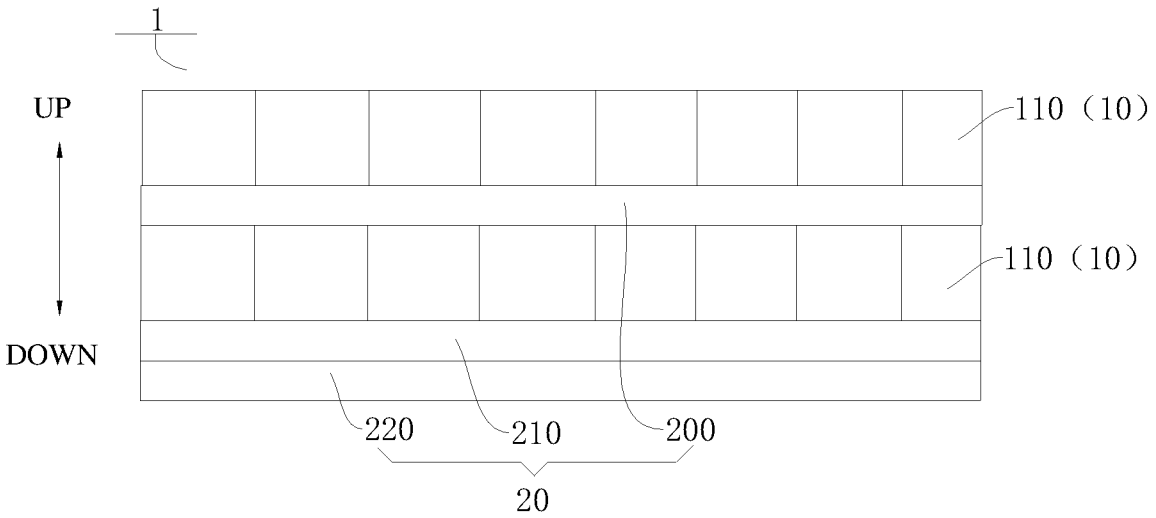
FIG. 7 is a simplified view of a heat pump system according to embodiments of the present disclosure.

As shown in FIG. 7, in some embodiments of the present disclosure, two microchannel plates 110 can be provided, and the induction heating sheet 200 is sandwiched between the two microchannel plates 110. For example, the two microchannel plate 110 can be arranged at the upper and the lower (referring to an up-down direction shown in FIG. 7) and spaced apart from each other. The induction heating sheet 200 is located between the microchannel plates 110, and the induction heating sheet 200 can be in contact with both of the two microchannel plates 110. The insulation plate 210 can be attached to a side of the lower microchannel plate 110 away from the induction heating sheet 200, and the electromagnetic induction wire coil 220 can be attached to a side of the insulation plate 210 away from the microchannel plate 110. Therefore, two sides of the induction heating sheet 200 can heat the two microchannel plates 110 respectively, such that the heat from the induction heating sheet 200 can be fully utilized, the operation efficiency of the electromagnetic heating assembly 20 can be raised, and a manufacturing cost of the heat pump system 1 can be reduced. In the description of the present disclosure, it should be noted that, the terms "up," "upper," "down," "lower" refer to the orientation or relation as shown in FIG. 7 for convenience of description of the present disclosure and simplification of the description, but do not alone indicate or imply that the device or element referred to must have a particular orientation, or is constructed or operated in a particular orientation, which shall not be construed to limit the present disclosure.

Figure 8:
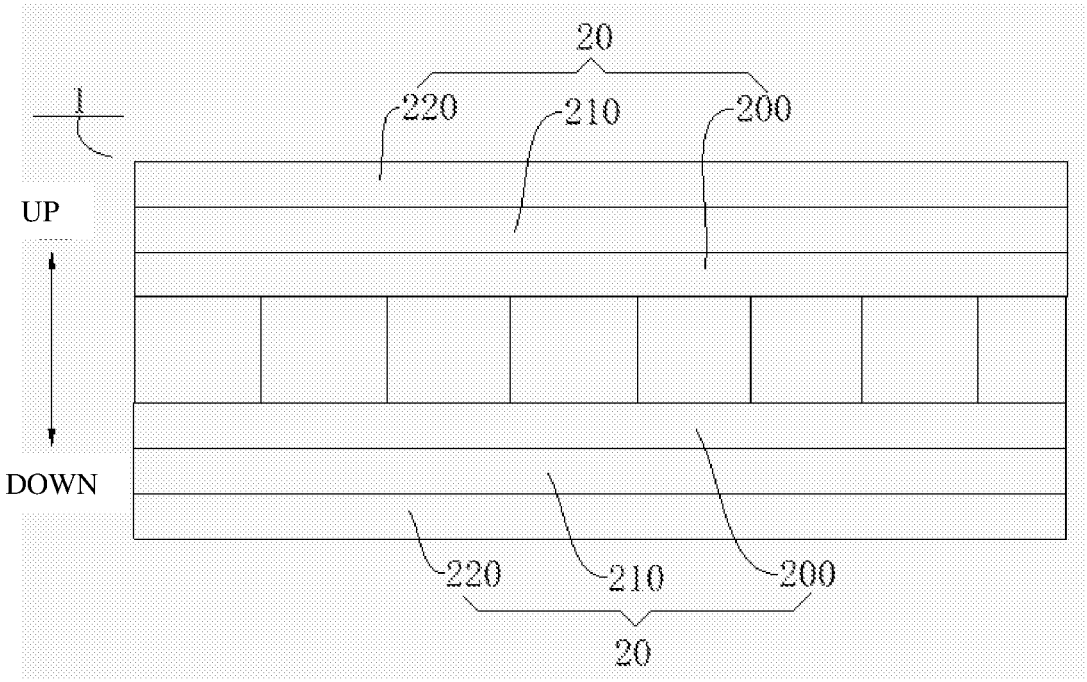
FIG. 8 is a simplified view of a heat pump system according to embodiments of the present disclosure.

As shown in FIG. 8, according to some embodiments of the present disclosure, two electromagnetic heating assembles 20 can be provided, the induction heating sheet 200, the insulation plate 210, and the electromagnetic induction wire coil 220 of each of the electromagnetic heating assemblies 20 are superposed in sequence, and the induction heating sheet 200 is attached to an outer surface of the outdoor heat exchanger 10. Therefore, two induction heating sheets 200 can be used for heating the microchannel plate 110. Moreover, each of the two induction heating sheets 200 is provided with one electromagnetic induction wire coil 220, and the electromagnetic induction wire coil 220 can heat the induction heating sheet 200 corresponding thereto, thereby raising the heating efficiency of the electromagnetic heating assembly 20.

As shown in FIG. 8, in some embodiments of the present disclosure, the two electromagnetic heating assemblies 20 are arranged on opposite surfaces of the outdoor heat exchanger 10 respectively. For example, the outdoor heat exchanger 10 can be the microchannel plate 110, and the two electromagnetic heating assemblies 20 are located at an upper surface and a lower surface of the microchannel plate 110 (referring to an up-down direction shown in FIG. 8) respectively. Both of the induction heating sheets 200 of the two electromagnetic heating assemblies 20 are in direct contact with the microchannel plate 110, and the insulation plate 210 of each of the electromagnetic heating assemblies 20 is located between the corresponding induction heating sheet 200 and the corresponding electromagnetic induction wire coil 220. Therefore, the two induction heating sheets 200 can be used for heating the microchannel plate 110. Moreover, the microchannel plate 110 is sandwiched between the two induction heating sheets 200, the contact area between the induction heating sheets 20 and the microchannel plate 110 can be fully enlarged, thereby raising the defrosting efficiency and the heating efficiency of the microchannel plate 110. Each of the two induction heating sheets 200 is provided with one electromagnetic induction wire coil 220, and the electromagnetic induction wire coil 220 can heat the induction heating sheet 200 corresponding thereto, thereby raising the heating efficiency of the electromagnetic heating assembly 20. In the description of the present disclosure, it should be noted that, the terms "up," "upper," "down," "lower" refer to the orientation or relation as shown in FIG. 8 for convenience of description of the present disclosure and simplification of the description, but do not alone indicate or imply that the device or element referred to must have a particular orientation, or is constructed or operated in a particular orientation, which shall not be construed to limit the present disclosure.

Figure 9:
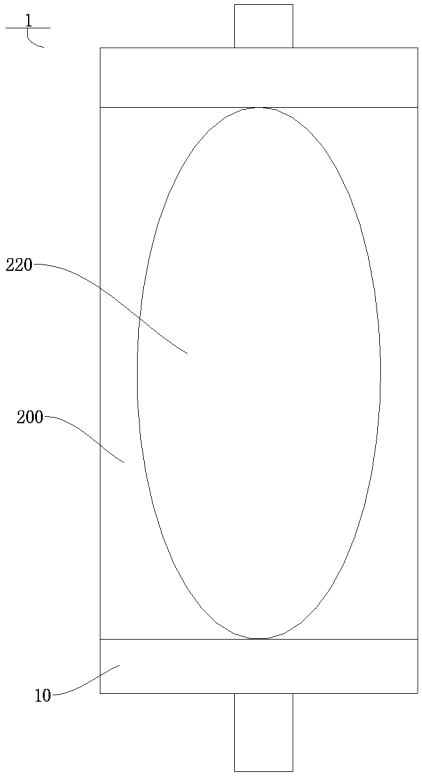
FIG. 9 is a simplified view of a heat pump system according to embodiments of the present disclosure.
Figure 10:
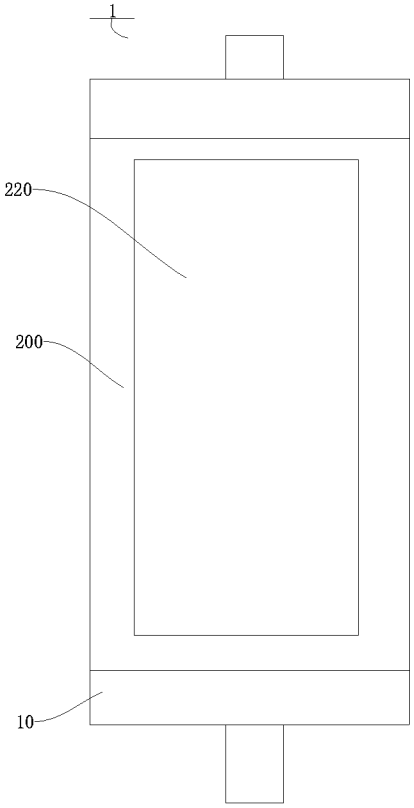
FIG. 10 is a simplified view of a heat pump system according to embodiments of the present disclosure.
Figure 11:
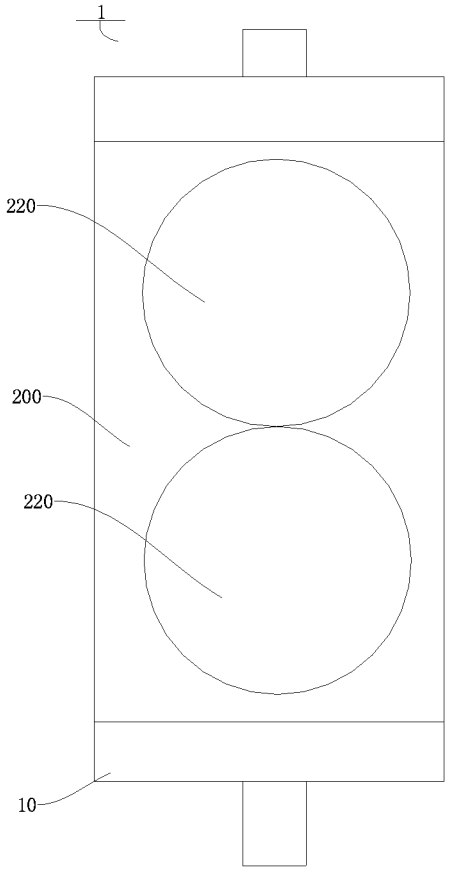
FIG. 11 is a simplified view of a heat pump system according to embodiments of the present disclosure.

As shown in FIG. 9 to FIG. 10, according to some embodiments of the present disclosure, the electromagnetic induction wire coil 220 can be circular, oval, or polygonal.

A control method for a heat pump system 1 according to embodiments of the present disclosure is provided, and the heat pump system is the heat pump system 1 as mentioned above. The heat pump system 1 includes a temperature sensor configured to detect a discharge temperature of a compressor. The discharge temperature detected by the temperature sensor is represented by T, and a target discharge temperature of the heat pump system 1 is set as $T_0$. The control method includes stating when the electromagnetic heating assembly the heat pump system is in a heating-start mode or a defrosting mode.

Based on the control method for the heat pump system 1 according to embodiments of the present disclosure, when the heat pump system 1 is in a heating-start mode or a defrosting mode, the electromagnetic heating assembly 20 can heat the outdoor heat exchanger 10 to raise its temperature, thereby raising defrosting efficiency and heating efficiency of the outdoor heat exchanger 10 and improving a starting capacity of the heat pump system 1 in case of "freeze", Debasement of reliability of the compressor due to insufficient discharge temperature can be avoided, and the usability of the heat pump system 1 can be improved. Moreover, the electromagnetic heating assembly 20 emits heat based on the principle of magnetic field, not only comparatively high safety is achieved, but also advantages, such as a simple structure, high heating precision, quick heating speed, and easy control can be brought out. In addition, the insulation plate 210 can insulate the electromagnetic induction wire coil 220 from the induction heating sheet 200, such that the induction heating sheet 200 can be prevented from affecting operation performance of the electromagnetic induction wire coil.

Figure 12:
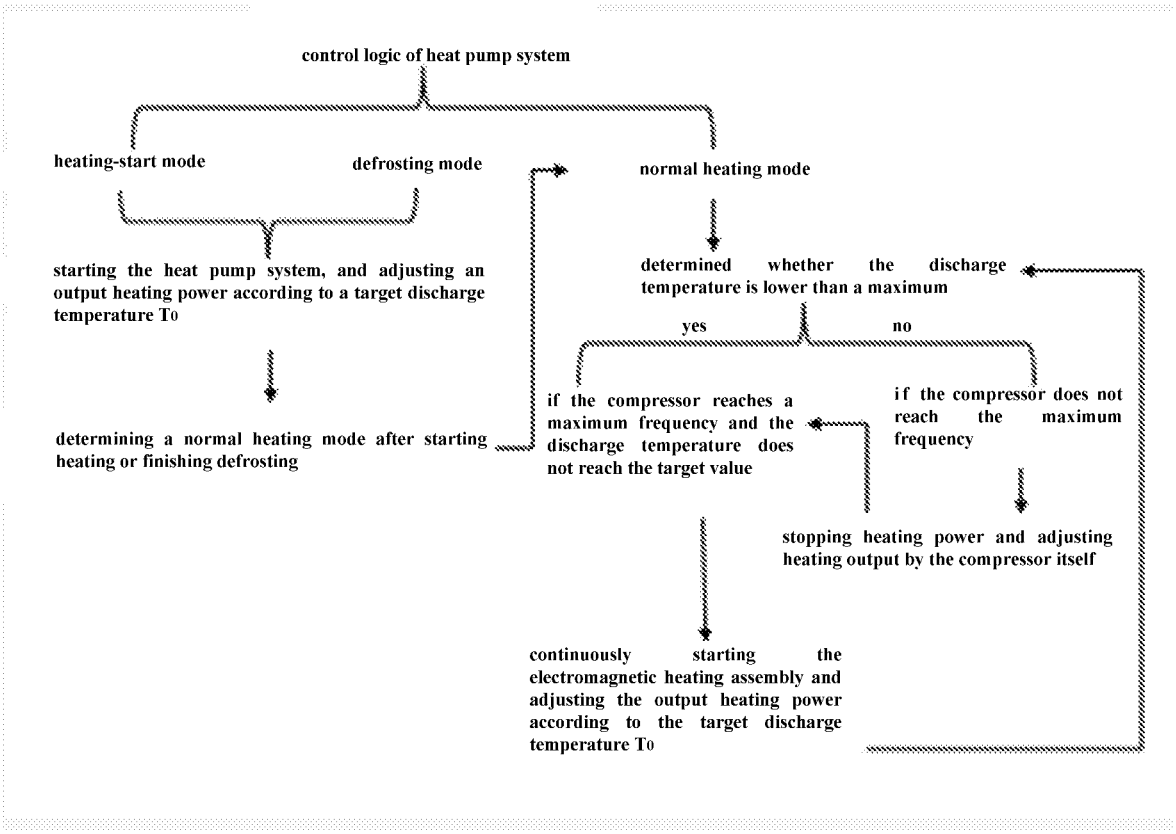
FIG. 12 is a logic diagram showing control of a heat pump system according to embodiments of the present disclosure.

As shown in FIG. 12, according to some embodiments of the present disclosure, in a normal heating mode, if T is less than $T_0$, and the compressor reaches a maximum frequency, the electromagnetic heating assembly is started. If T is greater than or equal to $T_0$, and the compressor does not reach the maximum frequency, the electromagnetic heating assembly stops heating. Therefore, the heat pump system can heat by air flow in combination with the electromagnetic heating assembly, thereby raising the heating efficiency of the heat pump system, and improving somatosensory comfort for users. The condition that the refrigeration oil is discharged from an oil separator by carrying due to insufficient discharge temperature can be avoided, which otherwise affects the reliability of the compressor, and the condition that an lubricating oil is carbonized at a high temperature due to an over-high discharge temperature.

Referring to FIG. 1 to FIG. 12, the heat pump system 1 according to embodiments of the present disclosure and the control method therefor are described in detail hereafter. It should be noted that, the description below is explanatory and shall not be construed to limit the present disclosure.

The objective of the present disclosure is to solve the problems in the related art, such as that the heat pump system is low in promotion of starting capacity in case of "freeze" when heating at a low temperature in cold region, that refrigeration oil is discharged from an oil separator by carrying in case of an insufficient discharge temperature, and that the defrosting speed is slow and the heating effect is poor. The present disclosure provides a hybrid-powered low-temperature strong-heat heat pump system which heats by air energy in combination with discharged gas, by adding the electromagnetic heating assembly at the outdoor heat exchanger, influence caused by ambient air temperature can be avoided, the heating capacity below −20° C. is not debased, electrically auxiliary heating is needless, quick heating can be provided, a hot wind output speed at heating start phase is doubled, a comfort experience can be felt quickly. Defrosting is quick, and the defrosting speed is doubled, and the comfort experience can be quickly recovered.

In order to accomplish the above objective, the heat pump system 1 of embodiments of the present disclosure can both normally cool and heating in an enhanced manner, and a heat sources in a heating mode includes two kinds of powers, i.e. air energy and heating by the electromagnetic heating assembly 20.

By arranging the electromagnetic heating assembly 20 on the outdoor heat exchanger 10, the refrigerant in the outdoor heat exchanger 10 can be further heated to acquire more heat energy, and then is conveyed into an indoor environment, thereby satisfying the requirement for indoor comfort. Meanwhile, in order to guarantee that the temperature of the electromagnetic heating assembly 20 is not over high, which otherwise causes carbonization of the refrigeration oil at a high temperature, an output power of the electromagnetic heating assembly 20 needs regulating according to a discharge temperature of the heat pump system 1.

In order to solve the problems that the heat pump system is low in start in case of "freeze", that refrigeration oil is easily discharged from an oil separator by carrying in case of an insufficient discharge temperature, and that reliability of the compressor is affected, the defrosting speed is slow, and the normal heating effect is poor, a control logic of the heat pump system 1 is as follows.

As shown in FIG. 12, actions includes starting the electromagnetic heating assembly in priority in the heating-start mode and the defrosting mode, adjusting an output heating power of the electromagnetic heating assembly according to a target discharge temperature $T_0$, and determining a normal heating mode after starting heating or finishing defrosting. In the normal heating mode, it is determined that whether the discharge temperature is lower than a maximum value. If yes, and the compressor reaches a maximum frequency and the discharge temperature does not reach the target value $T_0$, a heating device continues to start, and the output heating power of the electromagnetic heating assembly is adjusted according to the target discharge temperature $T_0$, in order to overcome a defect that the compressor has reached the maximum value but cannot provide good comfort experience. During the process, changes of the discharge temperature are continuously determined to meet the requirement that the maximum value cannot be exceeded. If the maximum value of the discharge temperature is exceeded, and the compressor does not reach the maximum frequency, output of the electromagnetic heating assembly is stopped, heating output is adjusted by the compressor itself. During adjustment, if the compressor reaches the maximum frequency, and the discharge temperature does not reaches the target value, the heating device continues to start, and the output heating power is adjusted according to the target discharge temperature $T_0$. The heating power of the electromagnetic heating assembly is repeatedly controlled in such a feedback manner.

As shown in FIG. 1 to FIG. 11, the electromagnetic heating assembly 20 includes the induction heating sheet 200, the insulation plate 210, and the electromagnetic induction wire coil 220. The electromagnetic induction wire coil 220 can generate the alternating magnetic field, in order to cause an eddy with the induction heating sheet 200 to generate heat energy. The electromagnetic induction wire coil 220 can be of various forms, such as oval, circle, rectangle, and number combination can be made according to needs. The induction heating sheet 200 can be an irony induction heating sheet containing an iron element. The induction heating sheet 200 and the outdoor heat exchanger 10 can be formed in a build-in structure or an enclosed structure, thereby raising a conversion rate of heat between the induction heating sheet 200 and the outdoor heat exchanger 10, and heat regulation of the induction heating sheet 200 is quick, the electromagnetic heating assembly 20 can output with a changed power. The electromagnetic induction wire coil 220 cannot be in direct contact with the irony induction heating sheet in consideration of demand for heat dissipation of the electromagnetic induction wire coil 220. The outdoor heat exchanger 10 can be made of metal or nonmetal material, and includes a passage end and a connecting tube for connection with a refrigerant system. The irony induction heating sheet 200 can be located in a refrigerant passage to directly heat a refrigerant, or located outside the refrigerant passage to indirectly heat the refrigerant.

When the induction heating sheet 200 is located in the outdoor heat exchanger 10, the heating efficiency is high, and the refrigerant can be heated in the outdoor heat exchanger 10. When the induction heating sheet 200 is located at the outside, the induction heating sheet 200 is tightly attached to an outer surface of the outdoor heat exchanger 10 and insulated by the insulation plate 210. The outdoor heat exchanger 10 can be the microchannel plate 110 or the heat exchange tube 100.

Throughout the description of the present disclosure, reference to "an embodiment," "some embodiments," "explanatory embodiment", "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A heat pump system, comprising:

an outdoor heat exchanger, wherein the outdoor heat exchanger is configured as a heat exchange tube, the induction heating sheet is located in the heat exchange tube, and the insulation plate is attached to an outer peripheral wall of the heat exchange tube; and an electromagnetic heating assembly, comprising:

an induction heating sheet, an insulation plate, and an electromagnetic induction wire coil, the induction heating sheet being in contact with the outdoor heat exchanger, the electromagnetic induction wire coil being attached to the insulation plate, the insulation plate being connected to the outdoor heat exchanger or the induction heating sheet, and the induction heating sheet being coupled with the electromagnetic induction wire coil in a feedback manner to generate an alternating magnetic field.

2. The heat pump system according to claim 1, wherein the heat exchange tube has two outer surfaces being a first surface as the upper side of the outer surface and a second surface as a lower side of the outer surface;

two insulation plates are provided, the two insulation plates being a first insulation plate and a second insulation plate, the first insulation plate is attached to the first surface, and the second insulation plate is attached to the second surface; and two electromagnetic induction wire coils are provided, the two electromagnetic induction wire coils being a first electromagnetic induction wire coil and a second electromagnetic induction wire coil, the first electromagnetic induction wire coil is attached to the first insulation plate, and the second electromagnetic induction wire coil is attached to the second insulation plate.

3. The heat pump system according to claim 1, wherein the outdoor heat exchanger is configured as a microchannel plate.

4. The heat pump system according to claim 3, wherein the induction heating sheet is attached to an outer peripheral wall of the outdoor heat exchanger.

5. The heat pump system according to claim 3, wherein the electromagnetic heating assembly comprises two induction heating sheets, the two induction heating sheets are located at opposite outer surfaces of the microchannel plate, and the insulation plate is attached to one of the induction heating sheets.

6. The heat pump system according to claim 3, wherein two microchannel plates are provided, and the induction heating sheet is sandwiched between the two microchannel plates.

7. The heat pump system according to claim 1, wherein two electromagnetic heating assembles are provided, the induction heating sheet, the insulation plate, and the electromagnetic induction wire coil of each of the electromagnetic heating assemblies are superposed in sequence, and the induction heating sheet is attached to an outer surface of the outdoor heat exchanger.

8. The heat pump system according to claim 7, wherein the two electromagnetic heating assembles are arranged at surfaces of the outdoor heat exchanger respectively.

9. The heat pump system according to claim 1, wherein the electromagnetic induction wire coil is circular, oval, or polygonal.

10. A control method for a heat pump system, wherein the heat pump system is the heat pump system according to claim 1, the heat pump system comprises a temperature sensor configured to detect a discharge temperature of a compressor, the discharge temperature detected by the temperature sensor is represented by T, and a target discharge temperature of the heat pump system is represented by $T_0$, the control method comprises: starting the electromagnetic heating assembly when the heat pump system is in a heating-start mode or a defrosting mode.

11. The control method according to claim 10, wherein in a normal heating mode, if T is less than $T_0$, and the compressor reaches a maximum frequency, the electromagnetic heating assembly is started; and if T is greater than or equal to $T_0$, and the compressor does not reach the maximum frequency, the electromagnetic heating assembly stops heating.

12. The heat pump system according to claim 4, wherein the electromagnetic heating assembly comprises two induction heating sheets, the two induction heating sheets are located at opposite outer surfaces of the microchannel plate, and the insulation plate is attached to one of the induction heating sheets.

13. The heat pump system according to claim 4, wherein two microchannel plates are provided, and the induction heating sheet is sandwiched between the two microchannel plates.

14. The heat pump system according to claim 5, wherein two microchannel plates are provided, and the induction heating sheet is sandwiched between the two microchannel plates.

15. The heat pump system according to claim 1, wherein two electromagnetic heating assembles are provided, the induction heating sheet, the insulation plate, and the electromagnetic induction wire coil of each of the electromagnetic heating assemblies are superposed in sequence, and the induction heating sheet is attached to an outer surface of the outdoor heat exchanger.

16. The heat pump system according to claim 2, wherein two electromagnetic heating assembles are provided, the induction heating sheet, the insulation plate, and the electromagnetic induction wire coil of each of the electromagnetic heating assemblies are superposed in sequence, and the induction heating sheet is attached to an outer surface of the outdoor heat exchanger.

17. The heat pump system according to claim 3, wherein two electromagnetic heating assembles are provided, the induction heating sheet, the insulation plate, and the electromagnetic induction wire coil of each of the electromagnetic heating assemblies are superposed in sequence, and the induction heating sheet is attached to an outer surface of the outdoor heat exchanger.

18. The heat pump system according to claim 4, wherein two electromagnetic heating assembles are provided, the induction heating sheet, the insulation plate, and the electromagnetic induction wire coil of each of the electromagnetic heating assemblies are superposed in sequence, and the induction heating sheet is attached to an outer surface of the outdoor heat exchanger.

19. The heat pump system according to claim 5, wherein two electromagnetic heating assembles are provided, the induction heating sheet, the insulation plate, and the electromagnetic induction wire coil of each of the electromagnetic heating assemblies are superposed in sequence, and the induction heating sheet is attached to an outer surface of the outdoor heat exchanger.

* * * * *